US006024300A

United States Patent [19]

Bolton

[11] Patent Number: 6,024,300

[45] Date of Patent: Feb. 15, 2000

[54] LIQUID DISPENSING APPARATUS

[76] Inventor: Terence W. Bolton, 148 Portland Road, Hove, East Sussex, BN 3 5QL, United Kingdom

[21] Appl. No.: 09/000,096

[22] PCT Filed: Mar. 21, 1996

[86] PCT No.: PCT/EP96/01225

§ 371 Date: Apr. 14, 1998

§ 102(e) Date: Apr. 14, 1998

[87] PCT Pub. No.: WO97/03757

PCT Pub. Date: Feb. 6, 1997

[30] Foreign Application Priority Data

Jul. 18, 1995 [GB] United Kingdom ..... 9514671

[51] Int. Cl.[7] ..... B05B 9/00

[52] U.S. Cl. ..... 239/326; 239/145; 239/311; 239/DIG. 14; 222/637

[58] Field of Search ..... 239/326, 145, 239/294, 346, DIG. 14, 311; 222/325, 630, 637

[56] References Cited

U.S. PATENT DOCUMENTS

| | | | |
|---|---|---|---|
| 4,079,893 | 3/1978 | Bass | 239/346 |
| 4,758,849 | 7/1988 | Piatt et al. | 346/143 |
| 5,190,220 | 3/1993 | Bolton | 239/326 |
| 5,248,096 | 9/1993 | Hoey et al. | 239/272 |
| 5,366,158 | 11/1994 | Robisch et al. | 239/346 |
| 5,421,518 | 6/1995 | Robisch et al. | 239/311 |
| 5,454,517 | 10/1995 | Naemura | 239/390 |
| 5,687,886 | 11/1997 | Bolton | 222/630 |
| 5,842,646 | 12/1998 | Katajima | 239/346 |

FOREIGN PATENT DOCUMENTS

| | | |
|---|---|---|
| 94 02 500 | 4/1994 | Germany . |
| 2 257 058 | 1/1993 | United Kingdom . |
| 94 26421 | 11/1994 | WIPO . |

*Primary Examiner*—Joseph A. Kaufman
*Assistant Examiner*—David Deal
*Attorney, Agent, or Firm*—Kinney & Lange P.A.

[57] ABSTRACT

Apparatus for dispensing a fine spray of liquid particles comprises a hollow tubular casing (1) whose internal cross section is formed with at least one abutment surface. A tubular liquid source (2) is positioned within the casing (1) with the abutment surface in close contact with the outer surface of the source to provide support thereto. The casing (1) includes a passageway for the flow of air from a mouthpiece (3) positioned at one end of the casing (1) to a nozzle (9) positioned at the other end of the casing (1) into which the discharge end of the liquid source protrudes. The liquid source may comprise a pen formed with a nib (14) of absorbent material.

20 Claims, 1 Drawing Sheet

11
10

11
9
10
16
1B
12
8

2
14
7
1A
4
6
5
3
6
5

15

LIQUID DISPENSING APPARATUS

This invention relates to apparatus for dispensing a fine spray of liquid particles and more especially to liquid dispensing apparatus known as air brushes.

Conventional air brushes comprise a liquid store connected to receive high pressure gas from a source. The high pressure gas passes over the liquid store to produce a spray of liquid particles which is directed by a nozzle onto an appropriate surface. The pressurised gas from the source is supplied to the air brush via a conduit and its flow is controlled by a manually operated or automatically controlled valve. Typically the pressurised gas source includes propellant and is contained in a heavy metal cylinder. JP-A-61042350 and UK 2177620A disclose such an air brush in which the liquid store takes the form of a felt-tipped pen.

My British Patent 2245196 and International Patent Application PCT/GB93/02332 disclose air brush apparatus for dispensing fine sprays of liquid particles. These air brushes comprise a hand or foot operated pump connected to supply air under pressure directly to a nozzle so positioned that air leaving the nozzle is directed onto and over a nib of a felt-tipped pen releasably supported within a holder with the absorbent nib of the pen in close proximity to the nozzle outlet to cause liquid from the nib to be dispensed as a fine particulate spray in air.

An airbrush including a cylindrical housing formed with a mouthpiece for use with a felt-tipped pen is disclosed in published British Patent Application 2257058. The pen disclosed in this application is of special design and includes an end cap formed with a hole to equalise the pressure within the pen reservoir to avoid the presence of a vacuum.

An improved tubular construction of air brush dispenser is disclosed in my co-pending International Patent Application WO 94/26421. This dispenser comprises a hollow tubular housing and a felt-tipped pen which is retained within and spaced from the inner wall of the housing. The tubular housing includes at one end a nozzle and at its other end a mouth piece through which air can be caused to flow through the tubular housing and over the pen to the outlet orifice of the nozzle. An abutment is provided within the housing for locating the pen within the housing with its absorbent nib at least partially within the boundary of the outlet orifice of the nozzle.

The present invention sets out to provide a simplified and relatively inexpensive dispenser which, as for my earlier Application WC 94/26421, removes the need for a pump but which, by a blowing action, causes the required fine spray of coloured particles to be removed from a liquid store such as an absorbent nib of a pen containing a colourant, ink, paint or the like. The air brush dispenser of the present application is an improvement over my earlier design in that it provides a simple and very secure means for locating a pen or cartridge within the tubular casing and has an outlet nozzle whose profile optimises the flow of air around the nib of the pen or other liquid source thereby enabling even young children to operate the dispenser to achieve coloring effects normally associated with much more expensive and complicated equipment. In a preferred embodiment, the invention provides a unique design in which, when the apparatus is not in use, the pen nib is covered to prevent drying or other damage occurring.

According to the present invention in one aspect, there is provided apparatus for dispensing a fine spray of liquid particles, the apparatus comprising an elongate hollow tubular casing within which is retained a pen formed with a nib of absorbent material, the casing including at one end a mouthpiece and at its other end a nozzle having an orifice into which the nib of the pen at least partially protrudes, spacings between the internal surface of the casing and the pen periphery defining one or more passageways for the flow of air blown into the casing through the mouthpiece which passes over the nib of the pen and leaves the casing through the orifice, the apparatus being characterised in that the internal cross-section is formed with a plurality of lengthwise-extending locating surfaces between which is retained the pen and in that the orifice of the nozzle communicates with an expansion chamber into which the nib of the pen can at least partially protrude, the spacings between neighbouring locating surfaces and the pen periphery defining passageways for the flow of air through the casing, this air leaving the casing through the orifice and the expansion chamber.

As the air flow enters the expansion chamber it accelerates to cause liquid particles to be removed from the surface of the absorbent nib of the pen and to produce a dispersion of these particles in air.

The locating means may comprise a plurality of fins extending inwardly from inner surfaces of the casing. The stop means may comprise steps formed in these fins.

The casing may be formed in two separable tubular parts, one such part terminating at one end in a socket into which one end of the other casing part can extend to define a relatively tight fit therewith. The mouthpiece may comprise an annular passageway defined between an inner surface of the casing and an elongate cap into one end of which the nib of the tubular source may extend, the other end of the cap being closed. The liquid source may selectively be positioned with its nib within or in close proximity to the casing nozzle or with its nib effectively sealed within the elongate cap.

In an alternative arrangement, the liquid source is permanently located within the casing with the tip of the nib appropriately positioned within or in close proximity to the orifice of the nozzle. A separable cap for the nozzle end of the casing may be provided when the dispersing apparatus is not in use.

The casing interior may be formed over at least a major part of its length with three or more generally flat sides, the apices between neighbouring sides defining passageways for the flow of air when a pen or cartridge is positioned in the casing. In another construction, the casing interior is oval in cross-section.

In an alternative construction, the locating means comprises an inner tube in which the liquid source locates, the air flow passageway being defined between the outer periphery of this tube and the internal periphery of an outer tube spaced from the inner tube and substantially coaxial therewith.

The casing is preferably produced from a plastics material. Other materials may, however, be used.

The invention will now be described by way of example only with reference to the accompanying diagrammatic drawings in which.

Figures 1, 2, 3, 4, 5:
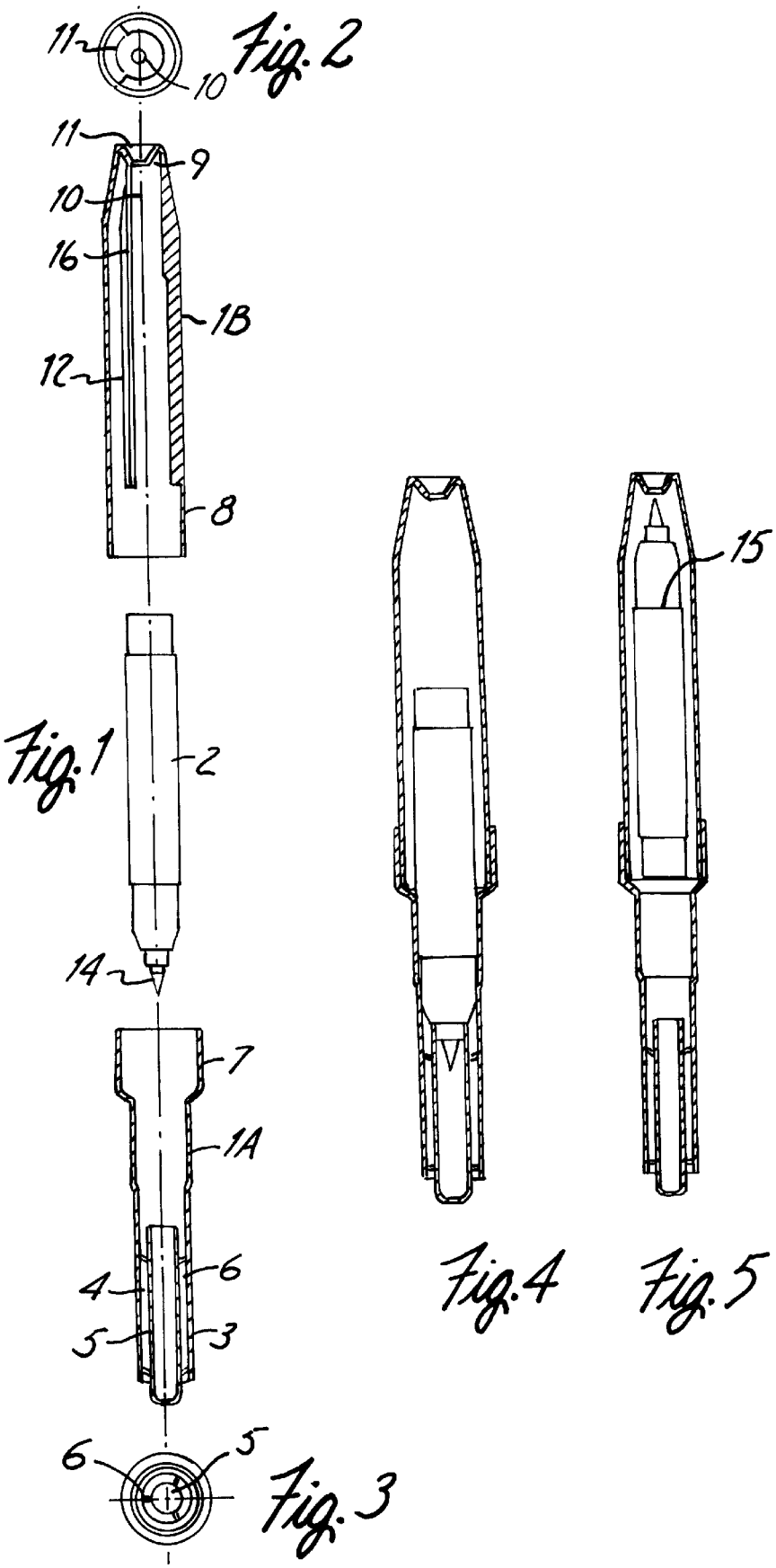
FIG. 1 is an exploded view partly in section of dispensing apparatus in accordance with the invention.
FIGS. 2 and 3 are end views of the apparatus illustrated in FIG. 1.
FIGS. 4 and 5 are side views in section of the assembled apparatus in its non-operational and operational modes respectively.

As will be seen particularly from FIG. 1 of the drawings, the apparatus comprises a tubular casing 1 formed in two separable parts 1A, 1B within which is housed a felt-tipped pen 2. Casing part 1A has a mouthpiece 3 which comprises an annular passageway 4 about a tubular cap 5 disposed at one end. The cap is spaced from the opposed internal wall surface of the casing part 1A by three fins 6. At its end remote from the mouthpiece 3, casing part 1A is flared to define a socket 7 into which can fit in a relatively tight manner one end 8 of casing part 1B. At its other end, casino part 1B has a nozzle 9 including an orifice 10 which opens into a converging expansion chamber 11. Three fins 12 protrude inwardly from the internal surfaces of the casing part 1B.

The body of the felt-tipped pen 2 has an absorbent nib 14. The absorbent nib defines the required source of liquid to be dispensed and the pen can be positioned within the casing 1 either with its nib 14 within the cap 5 of the mouthpiece 3 as shown in FIG. 4 or with its nib positioned within or in close proximity to the orifice 10 of the nozzle 9 as shown in FIG. 5. When in the former position, the nib 14 is effectively sealed within the cap 5 to prevent loss of fluid due to drying. When in the latter position, the pen is supported centrally within the casing 1 by the fins 12 with a shoulder 15 of the pen body abutting against projecting stops 16 of the fins 12. In this position, the pen nib 14 extends into or is in close proximity to the orifice 10 of the nozzle 9.

In use, air is blown by the user through the mouthpiece 3 and the annular passageways defined between the opposed surfaces of the pen body 2 and the internal surfaces of the casing 1. The fins 12 ensure that the pen is centralised within the casing. As the blown air approaches the outlet nozzle 9 it passes over the nib 14 and then leaves the casing through the orifice 10 and the expansion chamber 11. As the air enters and passes through the expansion chamber it accelerates thereby inducing a swirling motion which ensures effective removal of liquid particles from the nib 14 of the pen 2. Siting the nib correctly with respect to orifice 10 of the nozzle 9 enables even young children to produce high quality air brush effects when using the apparatus.

In an alternative unillustrated embodiment, the casing is generally triangular in cross-section over a major part of its length with the three sides of the casing acting as locating surfaces to hold the pen in position. Thus, the need for fins 12 is removed. The spaces between the apices of the internal surfaces of the casing and the pen body define the required passageways for the flow of air from the mouthpiece to the nozzle. In other respects, the casing may be the same as that shown in FIGS. 1 to 5.

Other casing shapes having more than three flat sides may be adopted. Thus, the casing may be square or diamond-shaped in cross-section. Also, the casing may be oval in cross-section.

The casing, nozzle and mouthpiece may be produced from plastics; other suitable materials may however be employed.

In a further unillustrated embodiment, the casing is made as or assembled into a single piece with the pen permanently located within the casing. In this arrangement, the tips of the fins 12 may be pointed or serrated so that they bite into the surface of the pen as it is loaded into the casing 1. Alternatively, the fins (or the tips thereof) may be of a resilient material which is compressed and deformed by the pen as it is loaded into the casing.

In a further unillustrated embodiment, the casino includes an inner tube within which the pen 2 is positioned relatively tightly. In this arrangement, the inner tube is positioned within and spaced from the internal surface of the casing to define an air flow passage which places the mouthpiece in communication with the casing nozzle. The inner tube is preferably substantially coaxial with the casing.

For all of the various embodiments described above, a finely dispersed spray of coloured ink particles in air is achieved simply by blowing through the mouthpiece of the respective dispensing apparatus. The improved features of the dispensing apparatus in accordance with the invention enables even young children to reproduce air brush effects normally associated with much more expensive and difficult to operate equipment. Also, it is possible to attach the mouthpiece of the dispensing apparatus to a simple hand or foot operated pump through a flexible tube. It is also possible to extend the length of the casing 1 by means of a simple extension tube fitted with a mouthpiece, the other end of the extension tube fitting over the mouthpiece of the casing. By so doing, children suffering from, for example, asthma are not excluded from using and enjoying the airbrush dispensing apparatus.

It will be appreciated that the apparatus described above is merely exemplary of dispensers in accordance with the invention and that modifications can readily be made thereto without departing from the true scope of the invention as set out in the appended claims.

I claim:

1. Apparatus for dispensing a fine spray of liquid particles, the apparatus comprising an elongate hollow tubular casing within which is retained a pen formed with a nib of absorbent material, the casing including at one end a mouthpiece and at its other end a nozzle having an orifice into which the nib of the pen at least partially protrudes, spacings between the internal surface of the casing and the pen periphery defining one or more passageways for the flow of air blown into the casing through the mouthpiece which passes over the nib of the pen and leaves the casing through the orifice, the apparatus being characterised in that the internal cross-section is formed with a plurality of lengthwise-extending locating surfaces between which is retained the pen and in that the orifice of the nozzle communicates with an expansion chamber into which the nib of the pen can at least partially protrude, the spacings between neighbouring locating surfaces and the pen periphery defining passageways for the flow of air through the casing, this air leaving the casing through the orifice and the expansion chamber.

2. Apparatus of claim 1 further comprising stop means within the casing against which a surface of the pen can abut to position the nib of the pen at least partially within the nozzle orifice.

3. Apparatus as claimed in claim 1 wherein the locating surfaces comprises a plurality of fins extending inwardly from the casing interior.

4. Apparatus as claimed in claim 3 wherein the stop means comprises steps formed in the fins.

5. Apparatus as claimed in claim 1 wherein the casing is formed in two separable tubular parts, one such part terminating at one end in a socket into which one end of the other casing part can extend to define a relatively tight fit therewith.

6. Apparatus as claimed in claim 1 wherein the mouthpiece comprises an annular passageway defined between an inner surface of the casing and an elongate cap into one end of which the nib of the pen may extend, the other end of the cap being closed.

7. Apparatus as claimed in claim 6 wherein the casing is constructed so that the pen can selectively be positioned with its nib within or in close proximity to the casing nozzle or with its nib effectively sealed within the elongate cap.

8. Apparatus as claimed in claim 1 wherein the casing interior is formed over at least a major part of its length with three or more generally flat sides, the sides defining the locating surfaces for the pen and, the apices between neighbouring sides defining passageways for the flow of air when a pen is positioned in the casing.

9. Apparatus as claimed in claim 1 wherein the locating surfaces are defined by the inner surfaces of an inner tube in which the liquid source locates, the air flow passageway being defined between the outer periphery of this tube and the internal periphery of an outer tube spaced from the inner tube and substantially coaxial therewith.

10. Apparatus as claimed in wherein the casing interior is formed over at least a major part of its length with three or more generally flat sides, the apices between neighbouring sides defining passageways for the flow of air when a pen or cartridge is positioned in the casing.

11. Apparatus for dispensing a fine spray of liquid particles, the apparatus comprising:

an elongate hollow tubular casing having at one end a nozzle with an orifice and at its other end a mouthpiece with a mouthpiece opening, the mouthpiece comprising a cap and an air passageway defined adjacent the cap, the cap being closed toward the mouthpiece opening and open toward the nozzle; and a pen having a nib formed of absorbent material, the pen being retained in the casing in a first position in which the nib of the pen protrudes in communication with the orifice of the nozzle such that air blown into the casing through the mouthpiece passes over the nib of the pen and leaves the casing through the orifice, and a second position reversed from the first position in which the nib of the pen extends into the cap to effectively seal the nib within the cap.

12. Apparatus as claimed in claim 11, wherein spacing between the internal surface of the casing and a periphery of the pen define one or more passageways for the flow of air.

13. Apparatus as claimed in claim 11, wherein the internal cross-section of the casing is formed with a plurality of lengthwise-extending locating surfaces between which is retained the pen.

14. Apparatus as claimed in claim 13 wherein the locating surfaces comprises a plurality of fins extending inwardly from the casing interior.

15. Apparatus as claimed in claim 14 further comprising stop means within the casing against which a surface of the pen can abut to position the nib of the pen relative to the nozzle orifice, wherein the stop means comprises steps formed in the fins.

16. Apparatus as claimed in claim 13 wherein the locating surfaces are defined by the inner surfaces of an inner tube in which a liquid source locates, the air flow passageway being defined between the outer periphery of this tube and the internal periphery of an outer tube spaced from the inner tube and substantially coaxial therewith.

17. Apparatus as claimed in claim 13 wherein the casing interior is formed over at least a major part of its length with three or more generally flat sides, the sides defining the locating surfaces for the pen, and the apices between neighbouring sides defining passageways for the flow of air when a pen is positioned in the casing.

18. Apparatus as claimed in claim 11, wherein the orifice of the nozzle communicates with an expansion chamber into which the nib of the pen in the first position at least partially protrudes.

19. Apparatus as claimed in claim 11, wherein the cap is elongated, and wherein the air passageway is annular and around the elongated cap.

20. Apparatus as claimed in claim 11 wherein the casing is formed in two tubular parts which mate together with a relatively tight fit and are separable to permit access to the pen for changing the pen between the first and second positions.

* * * * *